US010585378B2

(12) United States Patent
Okada

(10) Patent No.: US 10,585,378 B2
(45) Date of Patent: Mar. 10, 2020

(54) FIXING DEVICE AND IMAGE FORMING APPARATUS

(71) Applicant: KYOCERA Document Solutions Inc., Osaka (JP)

(72) Inventor: Seiji Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/455,266

(22) Filed: Jun. 27, 2019

(65) Prior Publication Data

US 2020/0004181 A1 Jan. 2, 2020

(30) Foreign Application Priority Data

Jun. 29, 2018 (JP) ..... 2018-124295

(51) Int. Cl.
*G03G 15/20* (2006.01)

(52) U.S. Cl.
CPC ..... *G03G 15/2028* (2013.01); *G03G 15/2032* (2013.01)

(58) Field of Classification Search
CPC ..... G03G 15/2028; G03G 15/2032
See application file for complete search history.

(56) References Cited

U.S. PATENT DOCUMENTS

2016/0004194 A1* 1/2016 Kondo ..... G03G 15/2032 399/323
2017/0205738 A1* 7/2017 Hidaka ..... G03G 15/2028
2018/0348679 A1* 12/2018 Shimohora ..... G03G 15/2028

FOREIGN PATENT DOCUMENTS

JP 2002-287553 A 10/2002
JP 2005-308955 A 11/2005
JP 2015-210304 A 11/2015

* cited by examiner

*Primary Examiner* — Carla J Therrien
(74) *Attorney, Agent, or Firm* — Studebaker & Brackett PC

(57) ABSTRACT

A fixing device includes a pressing roller, a rotating member, a heating means, a pressing mechanism, a separation member, a first biasing member and a moving mechanism. The pressing roller has a core metal and an elastic layer. The separation member includes a contact part. The first biasing member is configured to bias the separation member to be rotated in a direction in which the contact part is butted against the rotating member. The first biasing member includes a first end portion by which biasing force is acted on the separation member and a second end portion opposite to the first end portion. The moving mechanism is configured to move the second end portion of the first biasing member in a direction in which the biasing force is decreased, as the core metal approaches the rotating member owing to decrease in rigidity of the elastic layer of the pressing roller.

6 Claims, 11 Drawing Sheets

FIG. 8

| | deformation amount of elastic layer (mm) | increase in deformation amount (mm) | pressing load (g) | length of pressing area (mm) | abrasion amount | separation ability |
|---|---|---|---|---|---|---|
| initial state | 1.2 | - | 6 | 7 | ○ | ○ |
| 150,000 sheets passed | 1.5 | 0.3 | 4 | 7.5 | ○ | ○ |
| 300,000 sheets passed | 1.8 | 0.6 | 2 | 8 | ○ | ○ |

FIXING DEVICE AND IMAGE FORMING APPARATUS

INCORPORATION BY REFERENCE

This application is based on and claims the benefit of priority from Japanese patent application No. 2018-124295 filed on Jun. 29, 2018, which is incorporated by reference in its entirety.

BACKGROUND

The present disclosure relates to a fixing device to fix a toner image on a sheet and an image forming apparatus including the fixing device.

As a configuration of a fixing device to fix a toner on a sheet, the following configuration is well known. The fixing device having such a configuration includes a pressing roller having a core metal and an elastic layer, a rotating member (a fixing roller, a fixing belt or the others) coming into contact with an outer circumferential face of the pressing roller, a heating means to heat the rotating member and a pressing mechanism to press the pressing roller to the rotating member to form a pressing area through which the sheet is conveyed, between the pressing roller and the rotating member. Around an outer circumferential face of the rotating member, a release layer made of fluorocarbon resin is formed in order to promote the releasing of the toner.

In the above fixing device, a technique to release the sheet adhered on the rotating member from the rotating member is known. For example, there is a technique that a wedge-shaped or a plate-shaped separation member is arranged at the downstream side of the pressing area, and a tip end of the separation member buts against the outer circumferential face of the rotating member to separate the sheet from the rotating member. However, on butting the separation member against the rotating member, the release layer is scraped by the separation member and abraded. If the abrasion of the release layer proceeds, the melt toner may adhere to the rotating member or the adhered toner may be transferred on the next sheet to cause a toner offset.

Then, a technique for protecting the surface of the rotating member is discussed. For example, a configuration is proposed, in which a contact pressure of a separation claw (the separation member) to the fixing roller is increased at a timing when an end of a recording medium (the sheet) is passed through a contact position of the separation claw to the fixing roller and the contact pressure of the separation claw to the fixing roller is decreased at a timing after the end of the recording medium is passed through the contact position of the separation claw to the fixing roller.

By the way, as material of the elastic layer of the pressing roller, silicon rubber is conventionally employed. However, a rigidity of the silicon rubber is decreased with time. Particularly, these days, to meet a request for energy saving, foamed silicon rubber having a low heat capacity is frequently employed. Because the foamed silicon rubber has a volume ratio of the rubber to the whole volume lower than that of a solid rubber containing no pore, the rigidity is easily decreased. If the rigidity of the elastic layer is decreased, a deformation amount of the elastic layer is increased to lengthen the pressing area in the sheet conveyance direction and then to increase a heat volume transferred to the sheet. Then, an agglomerating force of the toner is decreased so that the sheet is easily separated from the rotating member.

However, in the above configuration, because a load applied on the rotating member by the separation member is not varied even if the rigidity of the elastic layer of the pressing roller is decreased, the abrasion of the rotating member proceeds by an excessive load.

SUMMARY

In accordance with an aspect of the present disclosure, a fixing device includes a pressing roller, a rotating member, a heating means, a pressing mechanism, a separation member, a first biasing member and a moving mechanism. The pressing roller has a core metal and an elastic layer formed around an outer circumferential face of the core metal. The rotating member is configured to come into contact with an outer circumferential face of the pressing roller. The heating means is configured to heat the rotating member. The pressing mechanism is configured to press the pressing roller to the rotating member to form a pressing area between the pressing roller and the rotating member. A sheet is conveyed through the pressing area. The separation member is arranged at a downstream side of the pressing area in a conveyance direction of the sheet and configured to separate the sheet from the rotating member. The separation member includes a rotating shaft part parallel to a rotating shaft of the pressing roller and a contact part coming into contact with an outer circumferential face of the rotating member. The first biasing member is configured to bias the separation member to be rotated in a direction in which the contact part is butted against the outer circumferential face of the rotating member. The first biasing member includes a first end portion by which biasing force is acted on the separation member and a second end portion opposite to the first end portion. The moving mechanism is configured to move the second end portion of the first biasing member in a direction in which the biasing force is decreased, as the core metal approaches the rotating member owing to decrease in rigidity of the elastic layer of the pressing roller.

In accordance with an aspect of the present disclosure, an image forming apparatus includes an image forming part configured to form a toner image on a sheet; and the fixing device configured to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 8 is a table showing a result of an experiment of the embodiment of the present disclosure.

DETAILED DESCRIPTION

Hereinafter, an image forming apparatus and a fixing device according to an embodiment of the present disclosure will be described with reference to the drawings.

Figure 1:
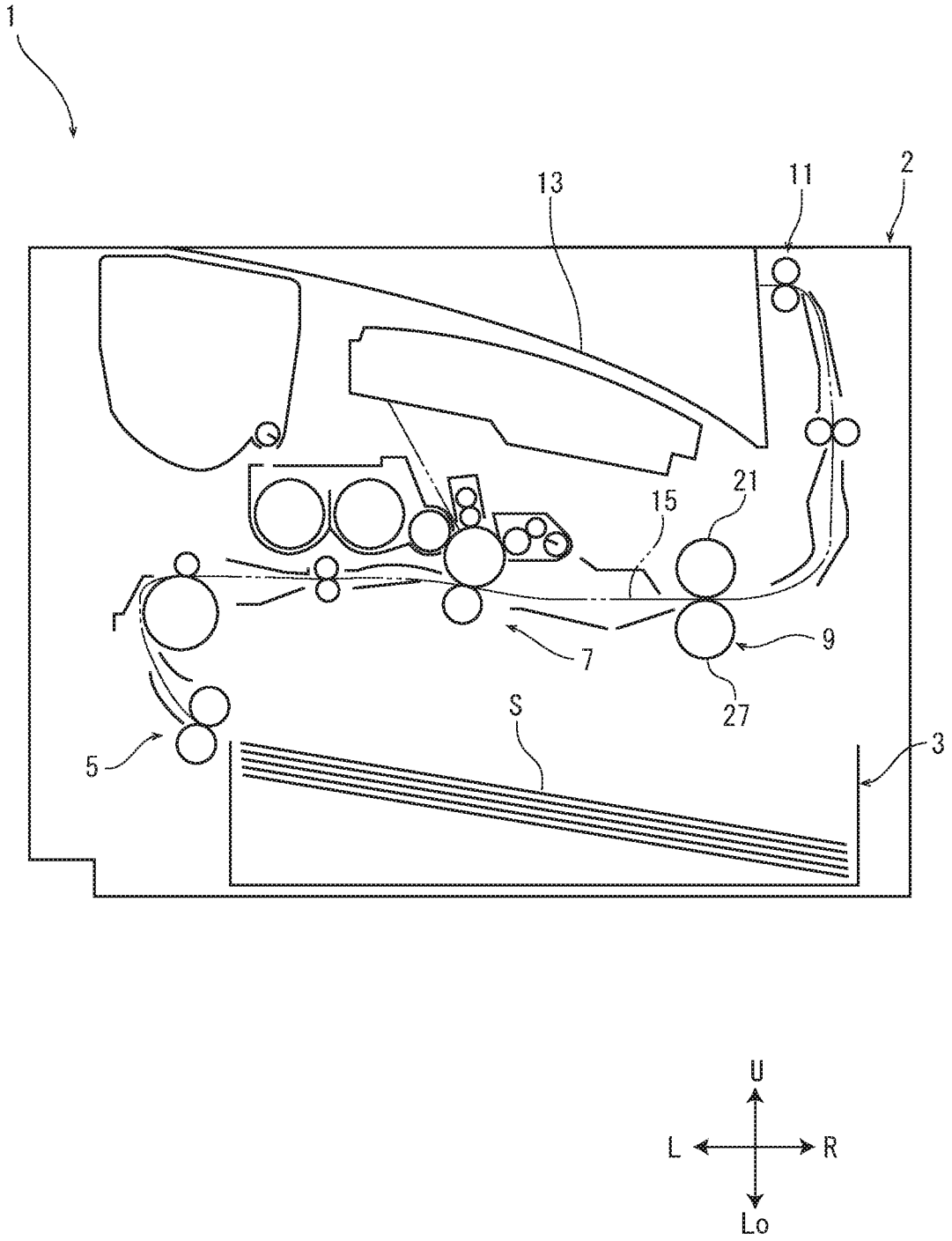
FIG. 1 is a front view schematically showing an inner structure of a printer according to an embodiment of the present disclosure.

First, with reference to FIG. 1, an entire structure of a printer 1 as an image forming apparatus will be described. FIG. 1 is a front view schematically showing an inner structure of the printer 1. In the following description, a near side (a front side) of a paper surface of FIG. 1 is defined to a front side of the printer 1, and a left-and-right direction is defined based on a direction in which the printer 1 is viewed from the front side. In each figure, U, Lo, L, R, Fr and Rr respectively show an upper side, a lower side, a left side, a right side, a front side and a rear side.

An apparatus main body 2 of the printer 1 is provided with a sheet feeding cartridge 3 in which a sheet S is stored, a sheet feeding device 5 configured to feed the sheet S from the sheet feeding cartridge 3, an image forming part 7 configured to form a toner image on the sheet S, a fixing device 9 configured to fix the toner image on the sheet S, a sheet ejecting device 11 configured to eject the sheet S and an ejected sheet tray 13 on which the ejected sheet S is stacked. Further, in the apparatus main body 2, a conveyance path 15 for the sheet S is formed from the sheet feeding device 5 towards the sheet ejecting device 11 via the image forming part 7 and the fixing device 9.

The sheet S fed from the sheet feeding cartridge 3 by the sheet feeding device 5 is conveyed to the image forming part 7 along the conveyance path 15, and a toner image is formed on the sheet S. The sheet S is conveyed to the fixing device 9 along the conveyance path 15, and the toner image is then fixed to the sheet S. The sheet S on which the toner image is fixed is ejected from the sheet ejecting device 11 to the ejected sheet tray 13.

Figure 2:
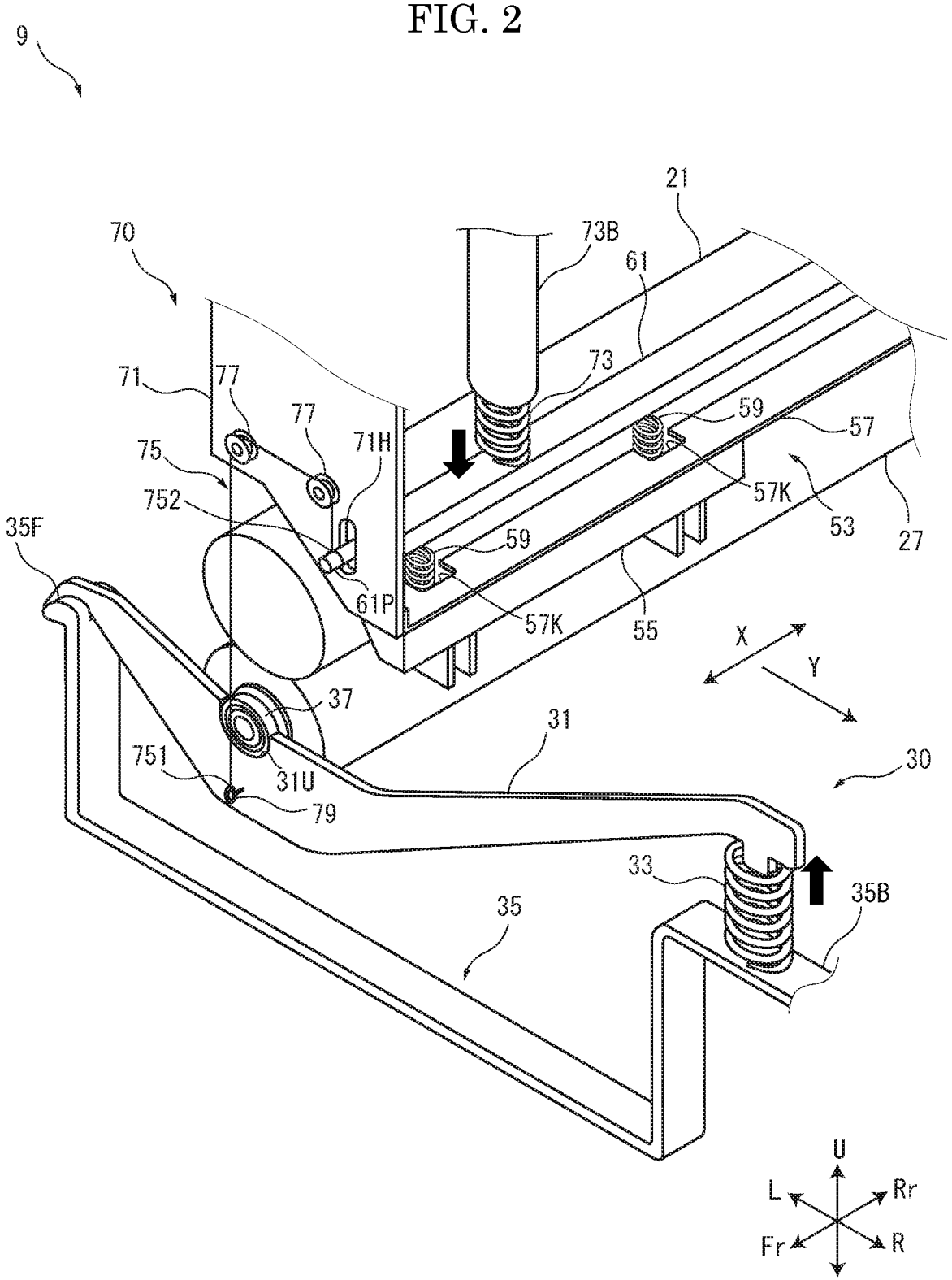
FIG. 2 is a perspective view showing a fixing device according to the embodiment of the present disclosure.
Figure 3:
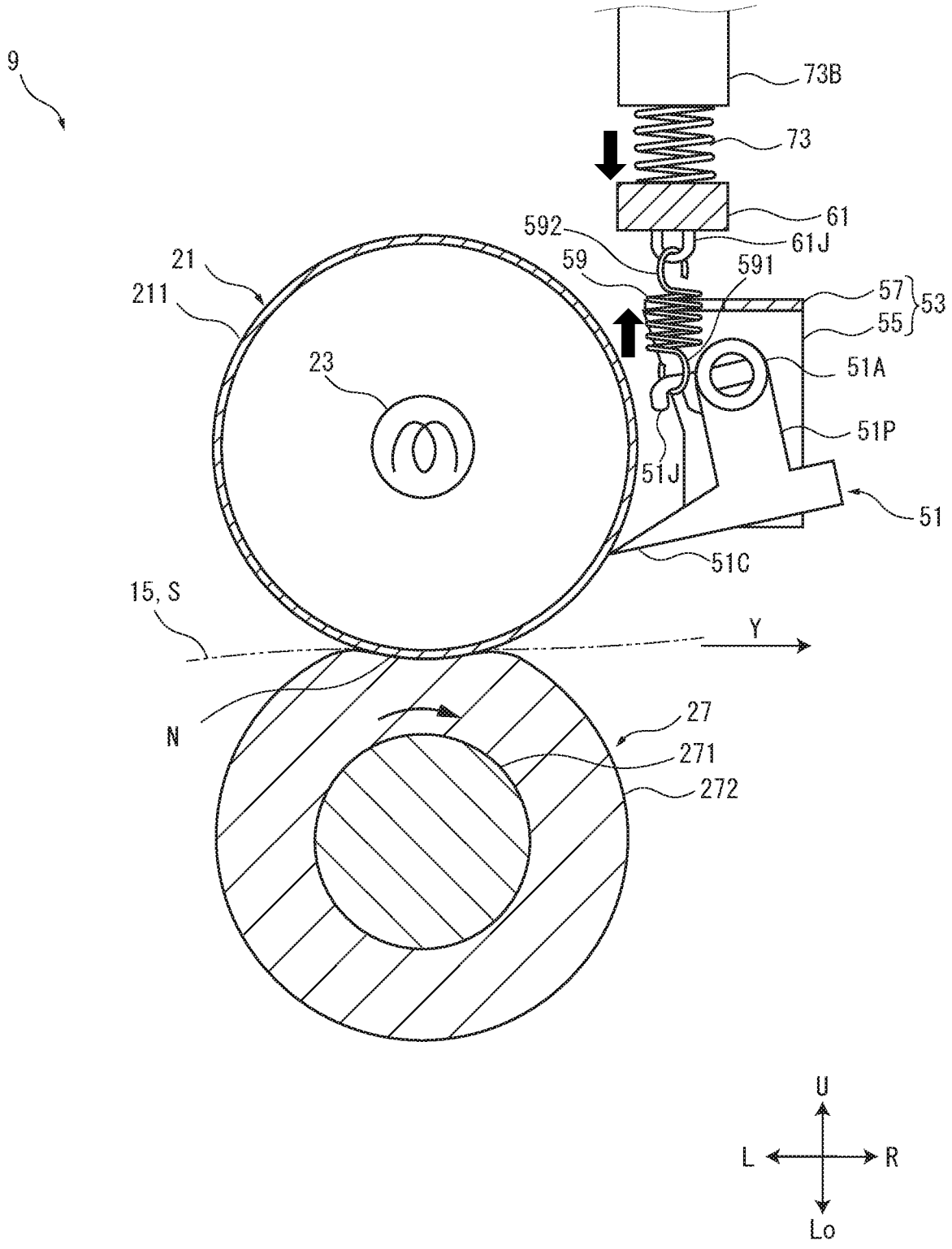
FIG. 3 is a cross sectional view showing the fixing device according to the embodiment of the present disclosure.
Figure 4:
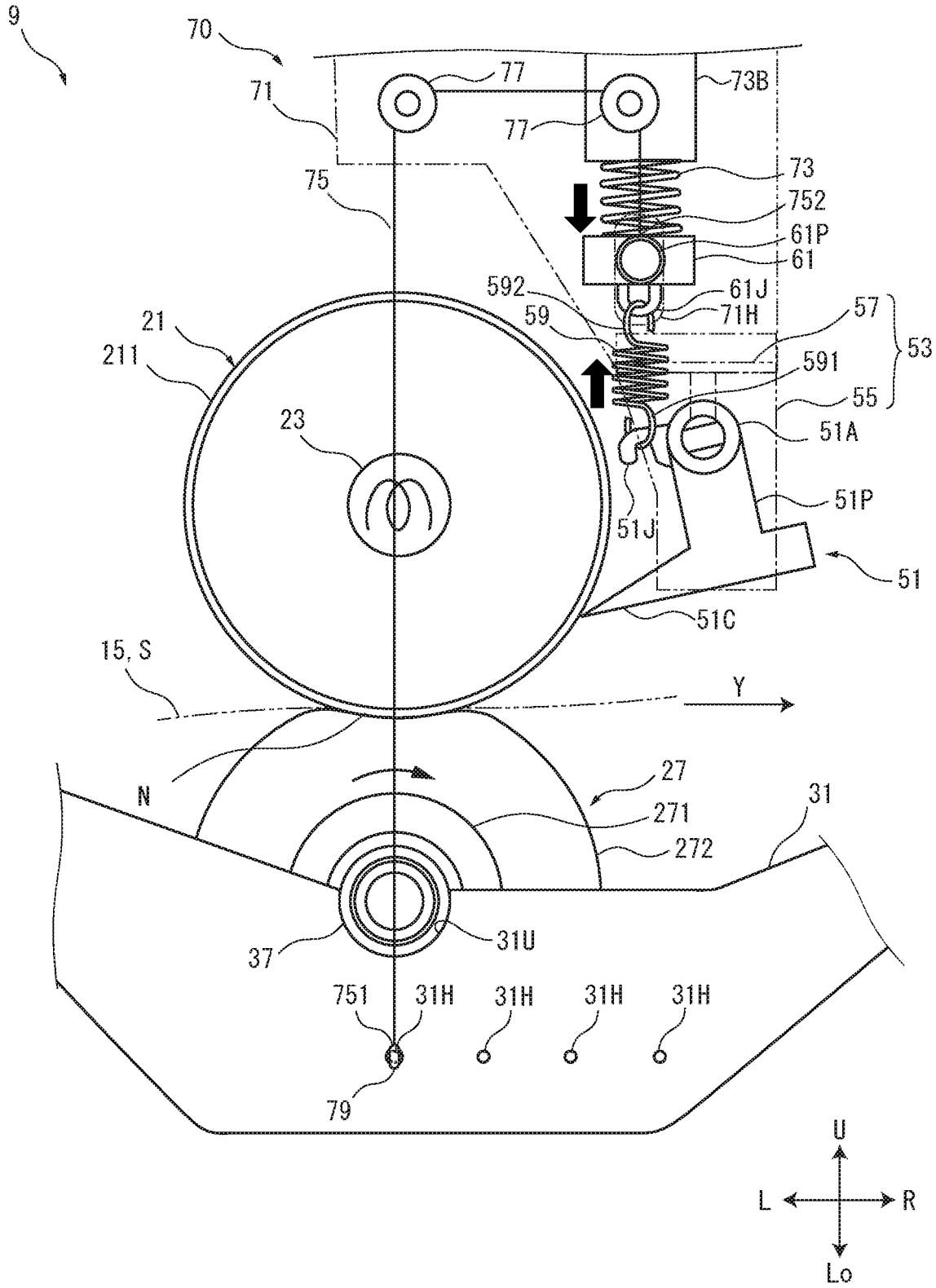
FIG. 4 is a front view showing the fixing device according to the embodiment of the present disclosure.
Figure 5:
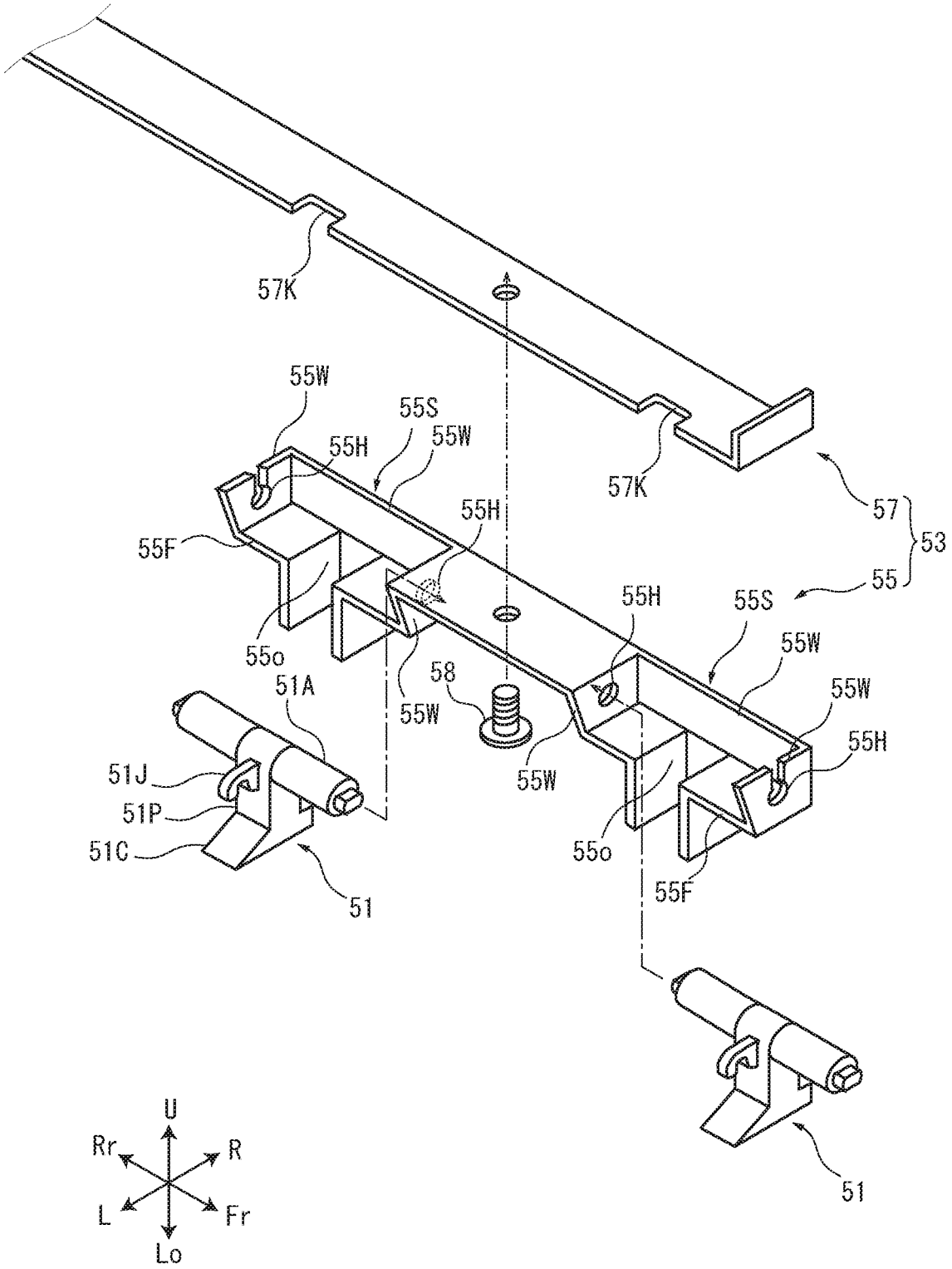
FIG. 5 is a disassembled view showing a separation member holder according to the embodiment of the present disclosure.
Figure 6:
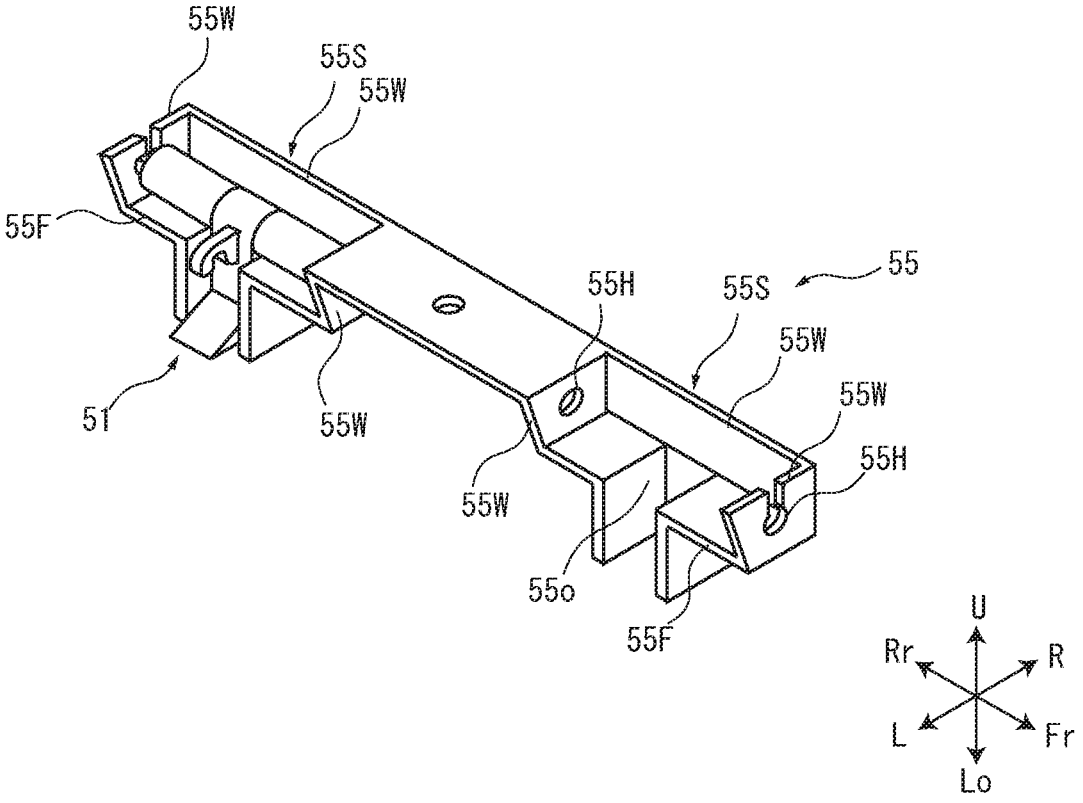
FIG. 6 is a perspective view showing a supporting member according to the embodiment of the present disclosure.

Next, with reference to FIG. 2 to FIG. 6, a configuration of the fixing device 9 will be described. FIG. 2 is a perspective view showing a front side portion of the fixing device 9. FIG. 3 is a cross sectional view of the fixing device 9. FIG. 4 is a front view of the fixing device 9. FIG. 5 is a disassembled view showing a front side portion of a separation member holder 53. FIG. 6 is a perspective view of a supporting member 55 in which a separation member 51 is stored. Hereinafter, the front side portion of the fixing device 9 will be described; a rear side portion of the fixing device 9 has the same configuration as that of the front side portion, except that its front-and-rear direction is inverted.

As shown in FIG. 2 and FIG. 4, the fixing device 9 includes a fixing roller 21 (an example of a rotating member), a halogen heater 23 (an example of a heating means) configured to heat the fixing roller 21, a pressing roller 27 having a core metal 271 and an elastic layer 272, a pressing mechanism 30 configured to press the pressing roller 27 on the fixing roller 21, a separation member 51 configured to separate the sheet from the fixing roller 21, a tension coil spring 59 (an example of a first biasing member) configured to bias the separation member 51 and a moving mechanism 70 configured to move an upper end of the tension coil spring 59. Hereinafter, an axial direction X shows axial directions (the front-and-rear direction) of the fixing roller 21 and the pressing roller 27. The present embodiment shows a case where the fixing device 9 is arranged in a posture that the pressing roller 27 is positioned below the fixing roller 21; however, the fixing device 9 may be arranged in any posture.

As shown in FIG. 3, the fixing roller 21 includes a cylindrical core metal 211 and a release layer (not shown) formed around an outer circumferential face of the core metal 211. The core metal 211 is made of metal, such as Al alloy or stainless steel, for example. The release layer is made of PTFE or PFA, for example. To each longitudinal end of the fixing roller 21, a cap and a rotating shaft (not shown) are attached. The rotating shafts are supported by bearings fixed to a housing of the fixing device 9.

The halogen heater 23 is a rod-shaped halogen lamp long in the axial direction X. The halogen heater 23 is disposed in an inner space of the fixing roller 21 to heat the fixing roller 21.

The pressing roller 27 includes the core metal 271, the elastic layer 272 provided around an outer circumferential face of the core metal 271 and a release layer (not shown) provided around an outer circumferential face of the elastic layer 272. The core metal 271 is made of metal, such as stainless steel or Al alloy, for example. The elastic layer 272 is made of foamed silicon rubber, for example. The release layer is made of PTFE and PFA, for example. To the pressing roller 27, driving force is transmitted by a drive source (not shown) such as a motor via a transmission mechanism (not shown) such as a gear. The core metal 271 is supported by a bearing 37.

The pressing mechanism 30 is configured to press the pressing roller 27 against the fixing roller 21 to form a pressing area N between the pressing roller 27 and the fixing roller 21. Through the pressing area N, the sheet S is conveyed. Specifically, as shown in FIG. 2 and FIG. 4, the pressing mechanism 30 includes a core metal supporting member 31 configured to support the core metal 271 of the pressing roller 27 and a compression coil spring 33 (an example of a second biasing member) configured to bias the core metal supporting member 31 toward the fixing roller 21.

The core metal supporting member 31 is a member long in the left-and-right direction and curved such that the left and right end portions are lower than the center portion. The core metal supporting member 31 is supported by a frame 35 fixed to the housing of the fixing device 9. The frame 35 has a fulcrum 35F formed at the left side of the pressing roller 27. The left end portion of the core metal supporting member 31 is supported by the fulcrum 35F. The frame 35 has a seat 35B formed at the right side of the pressing roller 27. A lower end of the compression coil spring 33 is coupled to the seat 35B. To an upper end of the compression coil spring 33, the right end portion of the core metal supporting member 31 is coupled. The core metal supporting member 31 has a recess 31U formed at a position closer to the left end portion than the center portion. The bearing 37 of the pressing roller 27 is fitted into the recess 31U.

The separation member 51 is arranged at the downstream side of the pressing area N in the conveyance direction of the sheet S, and configured to but against the outer circumferential face of the fixing roller 21 to separate the sheet S from the fixing roller 21. Specifically, as shown in FIG. 3 to FIG. 5, the separation member 51 includes a rotating shaft part 51A, a pole part 51P extending vertically from the rotating shaft part 51A, a wedge shaped contact part 51C protruding from the pole part 51P in a direction crossing to the longitudinal direction of the pole part 51P and a hook shaped connection part 51J formed at a side of the fixing roller 21 with respect to a rotation center of the rotating shaft part 51A.

The separation member 51 is supported by a separation member holder 53. As shown in FIG. 5, the separation member holder 53 includes a supporting member 55 configured to support the rotating shaft part 51A of the separation member 51 and a stay 57 configured to support the supporting member 55.

The supporting member 55 has two storage parts 55S configured to store the respective separation members 51. The storage part 55S is formed by a bottom part 55F and a wall part 55W formed at the right side, the front side and the rear side of the bottom part 55F, and has a space surrounded by the bottom part 55F and the wall part 55W. The space is long in the front-and-rear direction. In the front side portion and the rear side portion of the wall part 55W, holes 55H are formed, through which both the end portions of the rotating shaft part 51A of the separation member 51 is fitted. At a center of the bottom part 55F in the front-and-rear direction, an opening 55*o* is formed.

As shown in FIG. 6, the separation member 51 is stored in the storage part 55S such that both the end portions of the rotating shaft part 51A are fitted through the holes 55H of the storage part 55S with the axial direction of the rotating shaft part 51A being along the front-and-rear direction and the pole part 51P protrudes through the opening 55*o*.

The two storage parts 55S are provided side by side in the front-and-rear direction, and the two separation members 51 are stored in the supporting member 55 at the front side and the rear side. Of the two separation members 51, the separation member 51 at the rear side (at the center side in the longitudinal direction of the fixing roller 21) is arranged within a passing area of a small size sheet (for example, an area having a length of a long side of a JIS standard B5 size sheet) and the separation member 51 at the front side (at the longitudinal end side in the longitudinal direction of the fixing roller 21) is arranged outside the passing area of the small size sheet.

As shown in FIG. 2 and FIG. 5, the stay 57 is a plate shaped member long in the front-and-rear direction and has the same length as that of the fixing roller 21. The supporting member 55 is fixed to the stay 57 by a screw 58. The stay 57 is formed with a notch 57K at a position corresponding to the pole part 51P of the separation member 51 in the longitudinal direction.

A first end portion 591 (a lower end portion) of the tension coil spring 59 is connected to the connection part 51J of the separation member 51 and a second end portion 592 (an upper end portion) of the tension coil spring 59 is connected to a holding member 61 (described later). The connection part 51J is a working point where biasing force of the tension coil spring 59 is acted on the separation member 51, and the tension coil spring 59 biases the connection part 51J in a direction apart from the pressing roller 27. In other words, the tension coil spring 59 biases the separation member 51 so as to be rotated in a direction in which the connection part 51C buts against the outer circumferential face of the fixing roller 21.

As shown in FIG. 2 and FIG. 4, the moving mechanism 70 includes the holding member 61 configured to hold the second end portion 592 of the tension coil spring 59, a guide member 71 configured to guide the holding member 61 so as to move in the upper-and-lower direction (a direction crossing to the conveyance direction of the sheet S), a compression coil spring 73 (an example of a third biasing member) configured to bias the holding member 61 toward the pressing roller 27, a wire 75 configured to couple the core metal supporting member 31 to the holding member 61 and a pulley 77 around which the wire 75 is wound.

The holding member 61 is a rectangular rod shaped member long in the front-and-rear direction, and is formed with a projection 61P protruding from the front side end face. On a lower face of the holding member 61, a U-shaped connection part 61J is formed. The second end portion 592 of the tension coil spring 59 is connected to the connection part 61J.

The guide member 71 is a plate shaped member fixed to the housing of the fixing device 9, and is formed with a guide hole 71H long in the upper-and-lower direction. The projection 61P of the holding member 61 is inserted into the guide hole 71H of the guide member 71, and the holding member 61 is held by the guide member 71 in a movable manner in the upper-and-lower direction. A front end portion of the stay 57 of the separation member holder 53 is coupled to the guide member 71.

Toa pedestal 73B fixed to the housing of the fixing device 9, an upper end of the compression coil spring 73 is coupled, and a lower end of the compression coil spring 73 is fixed to an upper face of the holding member 61. The holding member 61 is biased downward (to the side of the pressing roller 27) by the compression coil spring 73.

At different positions of the core metal supporting member 31 in the longitudinal direction (a plurality of positions whose distances from the working point F are different), a plurality of screwed holes 31H is formed. To any one of the holes 31H, an eyebolt 79 is attached. A first end portion 751 of the wire 75 is connected to the eyebolt 79 and a second end portion 752 of the wire 75 is connected to the projection 61P of the holding member 61.

The pulley 77 is provided in the guide member 71. In this embodiment, the two pulleys 77 is provided; a number of the pulley 77 is not limited to two. However, at least the pulley 77 adjacent to the projection 61P of the holding member 61 on a path of the wire 75 is arranged above the projection 61P. In other words, the pulley 77 adjacent to the projection 61P of the holding member 61 on the path of the wire 75 is arranged at an upstream side of the projection 61P in a biasing direction of the compression coil spring 73.

Next, with reference to FIG. 2 to FIG. 4, a fixing operation of the fixing device 9 will be described. The right end portion of the core metal supporting member 31 is biased upward (to the side of the fixing roller 21) by the compression coil spring 33. Then, the core metal supporting member 31 is rotated around the fulcrum 35F in the counterclockwise direction, and the pressing roller 27 is pressed against the fixing roller 21 by the principle of lever. Thereby, between the pressing roller 27 and the fixing roller 21, the pressing area N through which the sheet S is conveyed is formed.

When the pressing roller 27 is driven to be rotated, the fixing roller 21 is driven to be rotated in a counter direction to the rotation direction of the pressing roller 27. After the fixing roller 21 is heated by the halogen heater 23 to a predetermined temperature, the sheet S on which the toner is transferred is conveyed to the pressing area N. At the pressing area N, the sheet S is put between the fixing roller 21 and the pressing roller 27 and conveyed in the predetermined conveyance direction Y. At this time, the toner is heated and pressed by the fixing roller 21 and fixed on the sheet S. The sheet S on which the toner is fixed is conveyed from the pressing area N to the downstream side while adhered on the fixing roller 21, and the sheet S is separated from the fixing roller 21 by the separation member 51 butting against the fixing roller 21 and then conveyed along the conveyance path 15.

As the above fixing operation is repeated, the rigidity of the elastic layer 272 of the pressing roller 27 is decreased. Then, because the core metal supporting member 31 is biased toward the fixing roller 21 by the compression coil spring 33, a deformation amount of the elastic layer 272 is increased and then the pressing area N is lengthened in the conveyance direction Y of the sheet S. If the pressing area N is lengthened, because a heat amount transferred to the sheet S is increased to increase a heat amount transferred to the toner. Then, because the agglomerating force of the toner is decreased, the sheet S is easily separated from the fixing roller 21. However, in a conventional fixing device, if the rigidity of the elastic layer 272 of the pressing roller 27 is decreased, because a load applied to the fixing roller 21 by the separation member 51 (hereinafter, called a pressing load of the separation member 51) is not varied, the abrasion of the fixing roller 21 proceeds by an excessive load.

Figure 7:
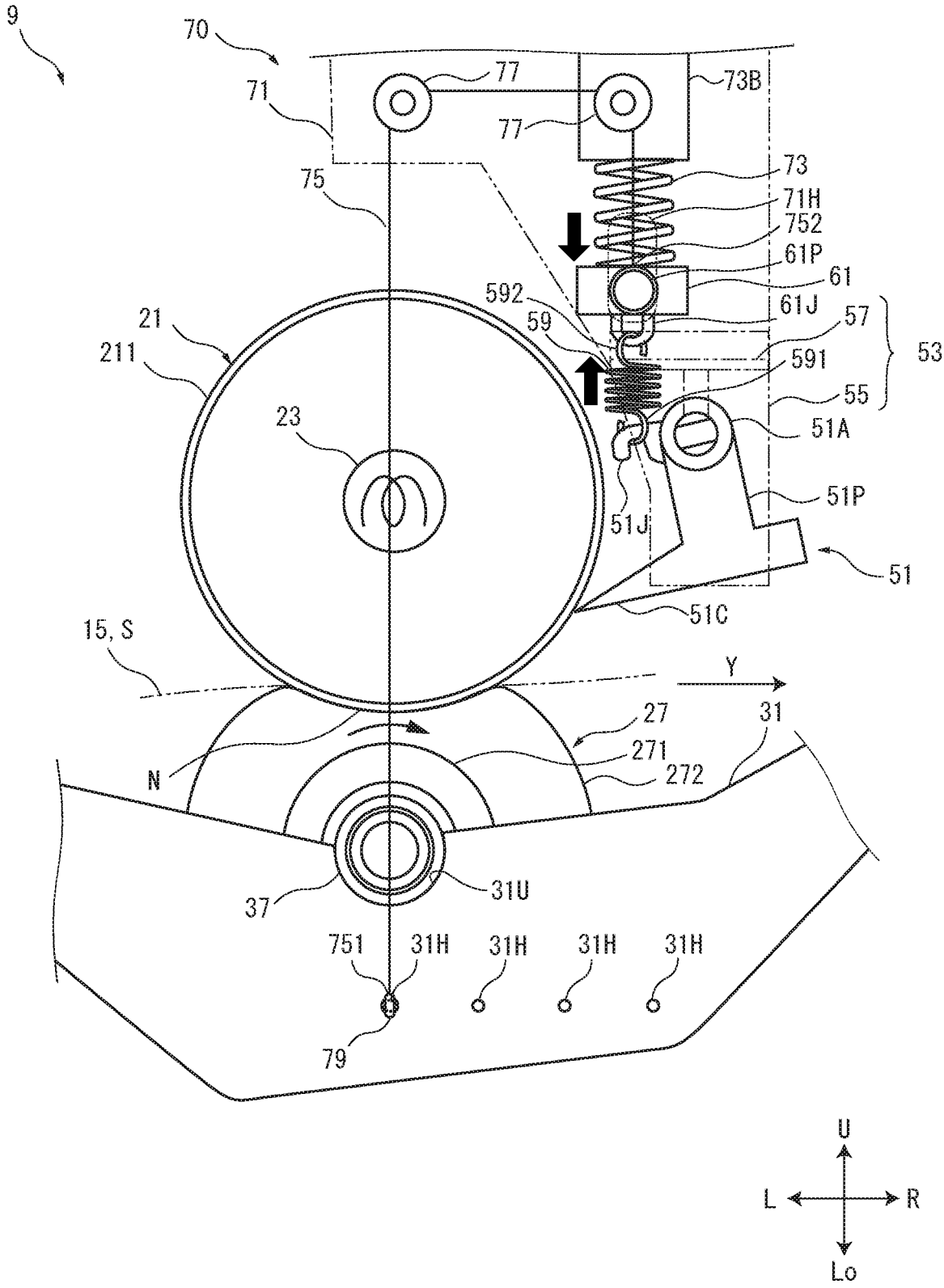
FIG. 7 is a front view showing the fixing device according to the embodiment of the present disclosure.

Next, with reference to FIG. 4 and FIG. 7, an operation of the fixing device of the present embodiment will be described. FIG. 7 is a front view showing the fixing device 9 when the rigidity of the elastic layer 272 is decreased. On the other hand, FIG. 4 shows the fixing device 9 before the rigidity of the elastic layer 272 is decreased. In the present embodiment, as the deformation amount of the elastic layer 272 owing to the decrease in rigidity is increased, the eyebolt 79 approaches the fixing roller 21. Because the holding member 61 is biased toward the pressing roller 27 by the compression coil spring 73, as the eyebolt 79 approaches the fixing roller 21, the holding member 61 is pushed downward. Then, the second end portion 592 of the tension coil spring 59 is lowered, and the biasing force of the tension coil spring 59 is decreased. That is, as the core metal 271 approaches the fixing roller 21 owing to the decrease in rigidity of the elastic layer 272 of the pressing roller 27, the moving mechanism 70 moves the end portion (the second end portion 592) of the tension coil spring 59 in a direction in which the biasing force is decreased, in which the end portion is on the side not the side of the working point where the biasing force of the tension coil spring 59 is acted on the separation member 51, of the two end portions (the first end portion 591 and the second end portion 592) of the tension coil spring 59. As a result, the pressing load of the separation member 51 is decreased.

According to the present embodiment, as the core metal 271 approaches the fixing roller 21 owing to the decrease in rigidity of the elastic layer 272 of the pressing roller 27, the pressing load of the separation member 51 is decreased. According to the configuration, compared with a case where the pressing load of the separation member 51 is not varied, it becomes possible to inhibit the abrasion of the fixing roller 21 when the rigidity of the elastic layer 272 of the pressing roller 27 is decreased.

Additionally, because the holes 31H are formed at positions whose distances from the fulcrum 35F are different, a moving distance of the first end portion 751 with respect to a rotational angle of the core metal supporting member 31 is different for each hole 31H. Accordingly, by varying the position of the first end portion 751, it becomes possible to adjust a decreasing rate of the pressing load of the separation member 51 with respect to the moving distance of the core metal 271.

Next, with reference to FIG. 8, a result of an experiment of the present embodiment will be described. FIG. 8 is a table showing the result of the experiment. The fixing operation for the sheet having a weight of 52 g/cm$^2$ was continuously performed, and the deformation amounts of the elastic layer 272 at an initial state, at a state where 150,000 sheets are passed and at a state where 300,000 sheets are passed, an increase of the deformation amount with respect to the initial state, the pressing load of the separation member 51 and the length of the pressing area N in the conveyance direction Y of the sheet S were measured. As for the abrasion amount, a depth of a recess of the release layer of the fixing roller 21 was measured at a position where the separation member 51 was butted against. Then, when the depth is less than 8 μm, it is evaluated to be good (○). The separation ability was checked as follows. The fixing operation for the toner image having a predetermined length from the front end of the sheet in the conveyance direction of the sheet was performed for ten times, and if a jamming owing to a winding of the sheet around the fixing roller 21 did not occur, it was evaluated to be good (○). Sizes of the fixing roller 21 and the pressing roller 27 of the fixing device employed to the experiment are as follows:

An outer diameter of the fixing roller 21: 35 mm,

A thickness of the core metal 211 of the fixing roller 21: 0.7 mm,

An outer diameter of the pressing roller 27: 35 mm, and

A thickness of the elastic layer 272 (millable foamed rubber) of the pressing roller 27: 9 mm.

The deformation amount of the elastic layer 272 is 1.2 mm at the initial state; is 1.5 mm (an increase of 0.3 mm) at the 150,000 sheets passing state; and is 1.8 mm (an increase of 0.6 mm) at the 300,000 sheets passing state. The pressing load of the separation member 51 is 6 g at the initial state; is 4 g at the 150,000 sheets passing state; and is 2 g at the 300,000 sheets passing state. The length of the pressing area is 7 mm at the initial state; is 7.5 mm at the 150,000 sheets passing state; and is 8 mm at the 300,000 sheets passing state. The abrasion amount and the separation ability were evaluated to be good at the initial state, at the 150,000 sheets passing state and at the 300,000 sheets passing state.

Figure 9:
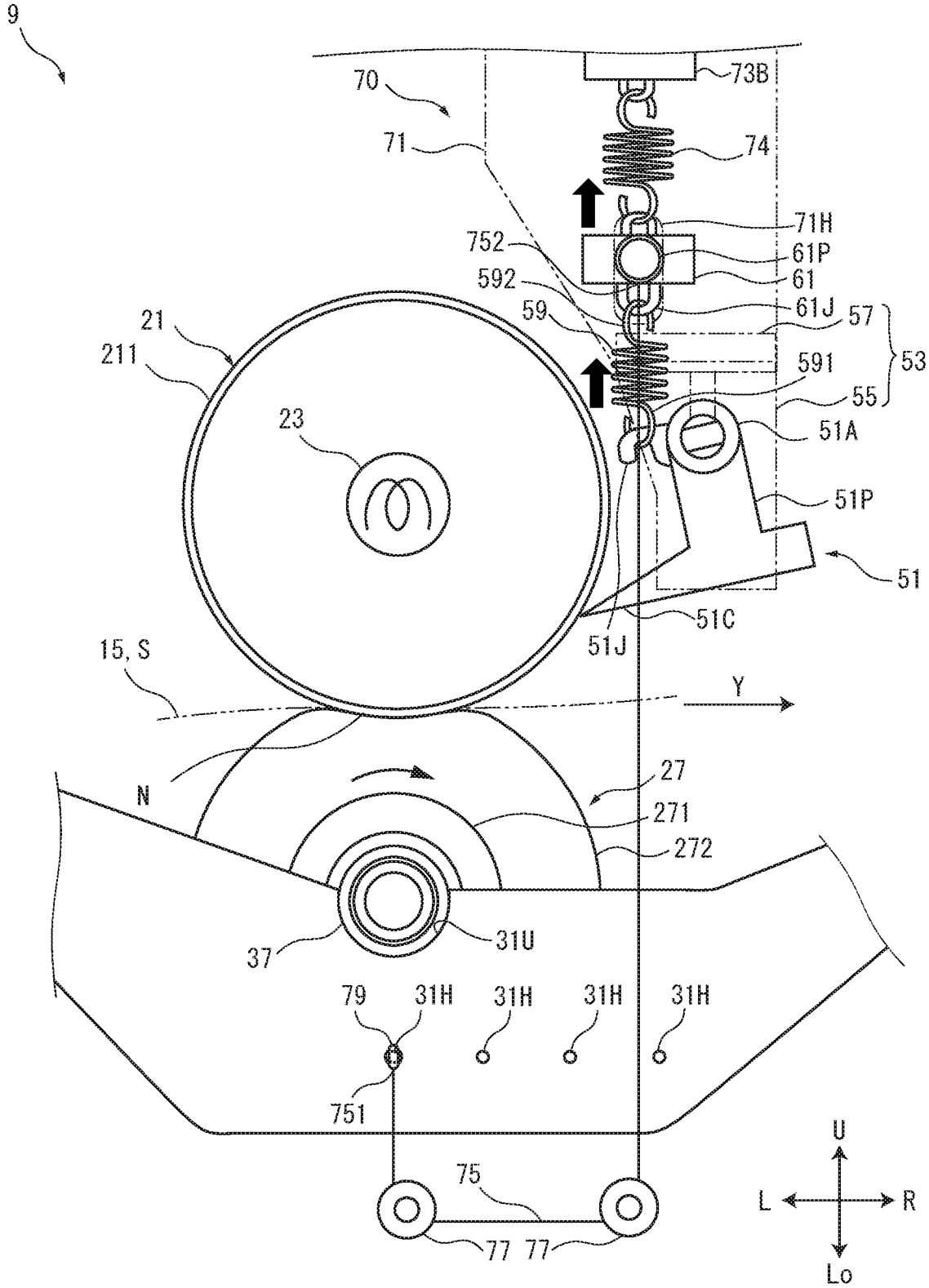
FIG. 9 is a front view showing a modified example of the fixing device according to the embodiment of the present disclosure.

The fixing device 9 may be modified as the following manner. FIG. 9 is a front view showing a modified example of the fixing device 9. In the example, the pulley 77 is provided below the core metal supporting member 31, and a tension coil spring 74 is provided in place of the compression coil spring 73 of the above embodiment. The holding member 61 is biased upward by the tension coil spring 74. As the deformation amount of the elastic layer 272 is increased owing to the decrease in rigidity of the elastic layer 272, the eyebolt 79 approaches the fixing roller 21, the eyebolt 79 pulls the wire 75 against the biasing force of the tension coil spring 74 and the holding member 61 is pulled downward. Then, the second end portion 592 (the end portion at the side not the side of the working point where the biasing force is acted on the separation member 51) of the tension coil spring 59 is lowered, and the biasing force of the tension coil spring 59 is decreased to decrease the pressing load of the separation member 51.

Figure 10:
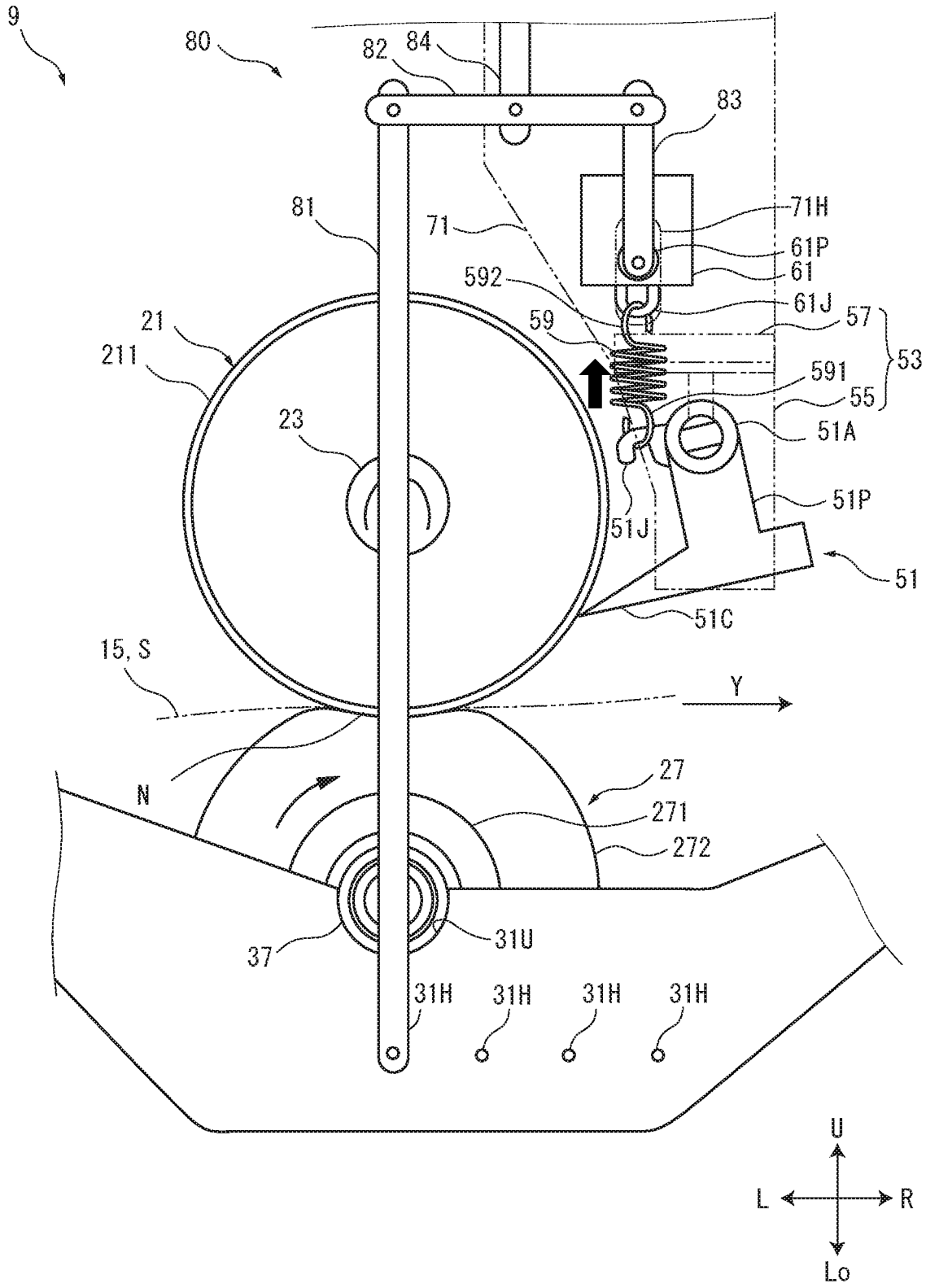
FIG. 10 is a front view showing the modified example of the fixing device according to the embodiment of the present disclosure.

Additionally, the fixing device 9 may be modified as the following manner. FIG. 10 is a front view showing the modified example of the fixing device 9. The example shows a case where the moving mechanism 80 employs a link mechanism in place of the moving mechanism 70. In the moving mechanism 80, one end of a link member 81 is coupled to the hole 31H of the core metal supporting member 31 by a pin, the other end of the link member 81 is coupled to one end of a link member 82 by a pin, the other end of the link member 82 is coupled to one end of a link member 83 by a pin and the other end of the link member 83 is coupled to the projection 61P of the holding member 61 by a pin. A center portion of the link member 82 is coupled to a hanging member 84 fixed to the housing, by a pin. As the deformation amount of the elastic layer 272 is increased owing to the decrease in rigidity of the elastic layer 272, the link member 81 is moved upward, the link member 82 is rotated in the clockwise direction and the link member 83 is moved downward. As a result, the holding member 61 is pushed downward. Then, the second end portion 592 (the end portion at the side not the side of the working point where the biasing force is acted on the separation member 51) of the tension coil spring 59 is lowered, and the biasing force of the tension coil spring 59 is decreased to decrease the pressing load of the separation member 51.

Figure 11:
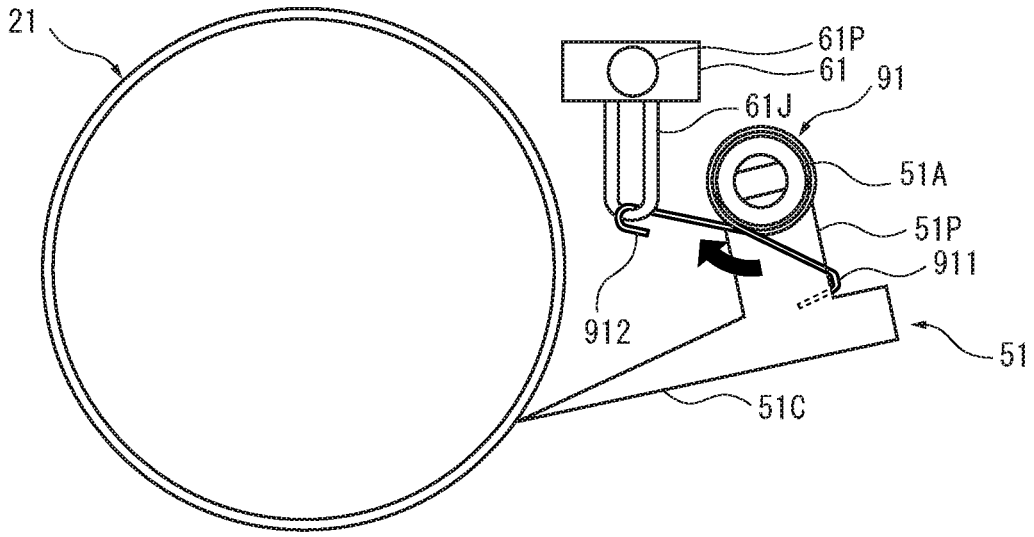
FIG. 11 is a front view showing a modified example of a first biasing member according to the embodiment of the present disclosure.

The first biasing member may be modified as the following manner. FIG. 11 is a front view showing a modified example of the first biasing member. The example shows a case where a torsion coil spring 91 is employed as the first biasing member in place of the tension coil spring 59. A first end portion 911 and a second end portion 912 of the torsion coil spring 91 are each formed into a hook shape. The first end portion 911 is wound around the pole part 51P of the separation member 51 to be attached thereto and the second end portion 912 is attached to the connection part 61J of the holding member 61. The pole part 51P is a working point where the biasing force is acted on the separation member 51, and the torsion coil spring 91 biases the separation member 51 to be rotated in a direction in which the contact part 51C is butted against the outer circumferential face of the fixing roller 21. When the holding member 61 is pulled downward, the second end portion 912 (the end portion at the side not the side of the working point where the biasing force is acted on the separation member 51) is lowered to decrease the biasing force of the torsion coil spring 91 and then to decrease the pressing load of the separation member 51. A plate spring may be employed in place of the torsion coil spring 91.

In the above embodiment and modified examples, the bearing 37 may be biased upward by a compression coil spring without providing the core metal supporting member 31.

As the heating means, a ceramic heater or an IH heater may be employed in place of the halogen heater 23.

The present disclosure may be applied to a configuration in which a fixing belt may be provided in place of the fixing roller 21, a pressing member (a pressing pad or a flat heater) coming contact with the inner circumferential face of the fixing belt may be provided and the fixing belt is put between the pressing member and the pressing roller 27.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A fixing device comprising:

a pressing roller having a core metal and an elastic layer formed around an outer circumferential face of the core metal;

a rotating member configured to come into contact with an outer circumferential face of the pressing roller;

a heating means configured to heat the rotating member;

a pressing mechanism configured to press the pressing roller to the rotating member to form a pressing area between the pressing roller and the rotating member, a sheet being conveyed through the pressing area;

a separation member being arranged at a downstream side of the pressing area in a conveyance direction of the sheet and configured to separate the sheet from the rotating member, the separation member including a rotating shaft part parallel to a rotating shaft of the pressing roller and a contact part coming into contact with an outer circumferential face of the rotating member;

a first biasing member configured to bias the separation member to be rotated in a direction in which the contact part is butted against the outer circumferential face of the rotating member, the first biasing member including a first end portion by which biasing force is acted on the separation member and a second end portion opposite to the first end portion; and a moving mechanism configured to move the second end portion of the first biasing member in a direction in which the biasing force is decreased, as the core metal approaches the rotating member owing to decrease in rigidity of the elastic layer of the pressing roller.

2. The fixing device according to claim 1, wherein the pressing mechanism includes:

a core metal supporting member configured to support the core metal of the pressing roller; and a second biasing member configured to bias the core metal supporting member toward the rotating member, the separation member includes a connection part formed at a side of the rotation member with respect to a rotational center of the rotating shaft part, the first biasing member is a tension coil spring of which the first end portion is connected to the connection part of the separation member to bias the connection part in a direction apart from the pressing roller, the moving mechanism includes:

a holding member configured to hold the second end portion of the first biasing member;

a guide member configured to guide the holding member so as to move in directions close to and apart from the pressing roller;

a third biasing member configured to bias the holding member in a direction close to the pressing roller;

a wire configured to couple the core metal supporting member to the holding member; and a pulley arranged at an upstream side of a connection position of the holding member and the wire in a biasing direction of the third biasing member, the wire being wound around the pulley.

3. The fixing device according to claim 2, wherein a moving direction of the holding member, a biasing direction of the first biasing member and a biasing direction of the second biasing member are parallel to each other.

4. The fixing device according to claim 2, wherein an approach amount of the core metal to the rotating member with respect to a decrease in the rigidity of the elastic layer of the pressing roller is variable.

5. The fixing device according to claim 4, wherein the core metal supporting member is a lever which is turned around a fulcrum, and the wire is connectable at a plurality positions whose distances from the fulcrum are different.

6. An image forming apparatus comprising:

an image forming part configured to form a toner image on a sheet; and the fixing device according to claim 1, configured to fix the toner image on the sheet.

* * * * *